US011240615B2

(12) United States Patent
Szmanda

(10) Patent No.: US 11,240,615 B2
(45) Date of Patent: Feb. 1, 2022

(54) APPARATUSES FOR COUPLING TO HEARING AIDS

(71) Applicant: Jeffrey P. Szmanda, Big Bend, WI (US)

(72) Inventor: Jeffrey P. Szmanda, Big Bend, WI (US)

( * ) Notice: Subject to any disclaimer, the term of this patent is extended or adjusted under 35 U.S.C. 154(b) by 0 days.

(21) Appl. No.: 17/092,801

(22) Filed: Nov. 9, 2020

(65) Prior Publication Data

US 2021/0152960 A1 May 20, 2021

Related U.S. Application Data

(60) Provisional application No. 63/059,285, filed on Jul. 31, 2020, provisional application No. 62/935,904, filed on Nov. 15, 2019.

(51) Int. Cl.
*H04R 25/00* (2006.01)

(52) U.S. Cl.
CPC ..... *H04R 25/65* (2013.01); *H04R 2225/025* (2013.01); *H04R 2460/17* (2013.01)

(58) Field of Classification Search
CPC ..... H04R 25/65; H04R 2225/025; H04R 2225/17
See application file for complete search history.

(56) References Cited

U.S. PATENT DOCUMENTS

| | | | |
|---|---|---|---|
| D263,253 | S | 3/1982 | Reynolds |
| D438,860 | S | 2/2001 | Darbut et al. |
| 6,690,806 | B1 | 2/2004 | Darbut et al. |
| D528,213 | S | 8/2006 | Darley et al. |
| D635,677 | S | 3/2011 | Voix et al. |
| D674,490 | S | 1/2013 | Bailey et al. |
| D701,459 | S | 3/2014 | Ghosh et al. |
| D728,107 | S | 4/2015 | Martin |
| 10,075,792 | B2 | 9/2018 | Szmanda |
| D831,832 | S | 10/2018 | Rappaport |
| D887,557 | S | 6/2020 | Szmanda |

(Continued)

FOREIGN PATENT DOCUMENTS

| | | |
|---|---|---|
| EP | 3 335 435 | 10/2020 |
| JP | H04132798 | 12/1992 |
| WO | 2017 027245 | 2/2017 |

OTHER PUBLICATIONS http://www.libertyhealthysupply.com/gator-grip-hearing-aid-insertion-tool-p/lhs-slc-1.htm.

(Continued)

*Primary Examiner* — Sunita Joshi
(74) *Attorney, Agent, or Firm* — Andrus Intellectual Property Law, LLP

(57) ABSTRACT

An apparatus for connecting to an ear canal component of a hearing aid includes a sleeve having a first end, an opposite second end, and a channel extending between the first end and the second end. The sleeve is configured to engage the ear canal component such that the ear canal component is in the channel. A flap is coupled to the sleeve and pivotable into and between an open position in which the channel at the second end of the sleeve is open and a closed position in which the flap closes the channel at the second end of the sleeve. When the flap is in the closed position, the flap prevents the ear canal component from passing out of the channel through the second end of the sleeve.

9 Claims, 24 Drawing Sheets

(56) References Cited

U.S. PATENT DOCUMENTS

| | | | | |
|---|---|---|---|---|
| 2002/0189627 | A1 | 12/2002 | Tang | |
| 2006/0215862 | A1 | 9/2006 | Hyunh et al. | |
| 2007/0003087 | A1 | 1/2007 | Ram et al. | |
| 2007/0036374 | A1 | 2/2007 | Bauman et al. | |
| 2009/0082801 | A1 | 9/2009 | Giese et al. | |
| 2009/0285428 | A1 | 11/2009 | Gilgert | |
| 2012/0087526 | A1 | 4/2012 | Higgins | |
| 2012/0230528 | A1 | 9/2012 | Pander et al. | |
| 2014/0205123 | A1* | 7/2014 | Lafort | H04R 25/607 381/329 |
| 2016/0286324 | A1 | 9/2016 | van den Berg et al. | |
| 2017/0048630 | A1* | 2/2017 | Szmanda | B25B 13/50 |

OTHER PUBLICATIONS

International Search Report and Written Opinion in PCT/US2016/045019 dated Jan. 11, 2017.
European Search Report in EP 16835626.9 dated Mar. 12, 2019.

* cited by examiner

APPARATUSES FOR COUPLING TO HEARING AIDS

CROSS-REFERENCE TO RELATED APPLICATIONS

The present disclosure is based on and claims priority to U.S. Provisional Patent Application Nos. 62/935,904 filed Nov. 15, 2019, and 63/059,285 filed Jul. 31, 2020, the disclosures of which are incorporated herein by reference.

FIELD

The present disclosure relates to hearing aids, and specifically to apparatuses that are coupled to hearing aids to increase maneuverability of ear canal components in the ear canal to achieve sufficiently deep insertion in the ear canal.

BACKGROUND

This Background is intended to introduce various aspects of the art, which may be associated with the present disclosure to thereby assist in providing a framework to facilitate a better understanding of particular aspects of the present disclosure. Accordingly, it should be understood that this Background should be read in this light, and not necessarily as admissions of prior art.

Hearing aids are used by hearing impaired persons to amplify and direct sounds toward the eardrum. Often, hearing aids have small components that must be inserted into the ear canal, however, these small components can be difficult to properly insert in the ear canal. Accordingly, apparatuses or devices can be connected to the small components of the hearing aid (or integrally formed with the small components) to help the person guide, maneuver, and/or direct the small components into proper placement in the ear canal. Examples of apparatuses that can be connected to small components of the hearing aids are described in U.S. Pat. No. 10,075,792, which is incorporated herein in entirety.

The present inventor has recognized that connecting apparatuses to small components of the hearing aids can be difficult especially for older adults, veterans, and people with any of a number of physical limitations. Further, current methods of connecting or retrofitting the apparatuses to the small component of the hearing aid can be difficult. For example, applying glue to the apparatus and/or the small component of the hearing aid has many problems. For instance, it can be difficult to keep the glue off the other components of the hearing aid, the retrofitter's hands and fingertips, the exterior surfaces of the apparatus, and/or the work surface. In other instances, the glue applicator tip may become clogged. Further, the glue may not make a permanent, long-lasting connection between the apparatus and the small component of the hearing aid. Still further, gluing the apparatus to the small component of the hearing aid may be prohibitively time consuming. Accordingly, the present inventor has developed new devices and methods of the present disclosure for connecting apparatuses to small components of the hearing aids.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to an example of the present disclosure, an apparatus for connecting to an ear canal component of a hearing aid includes a sleeve having a first end, an opposite second end, and a channel extending between the first end and the second end. The sleeve is configured to engage the ear canal component such that the ear canal component is in the channel. A flap is coupled to the sleeve and pivotable into and between an open position in which the channel at the second end of the sleeve is open and a closed position in which the flap closes the channel at the second end of the sleeve. When the flap is in the closed position, the flap prevents the ear canal component from passing out of the channel through the second end of the sleeve.

According to an example of the present disclosure, an apparatus for connecting to an ear canal component of a hearing aid includes a sleeve having a first end, an opposite second end, an opening between the first end and the second end, and a channel extending between the first end and the second end. The sleeve is configured to engage the ear canal component such that the ear canal component is in the channel. A resilient member on the sleeve extends through the opening to engage the ear canal component and prevent the sleeve from inadvertently sliding out of the channel.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The inventor has discovered through research and experimentation that it is advantageous for a hearing aid to include an apparatus that allows a user to control and position an ear canal component of the hearing aid into an ear canal. More specifically, the apparatus is an ergonomically-designed fingertip fitting guide that can couple to the ear canal component to increase the control over the ear canal component while the user positions the ear canal component into the ear canal. The apparatus can also prevent damage to the hearing aid (such as the ear canal component or the connector).

Figure 1:
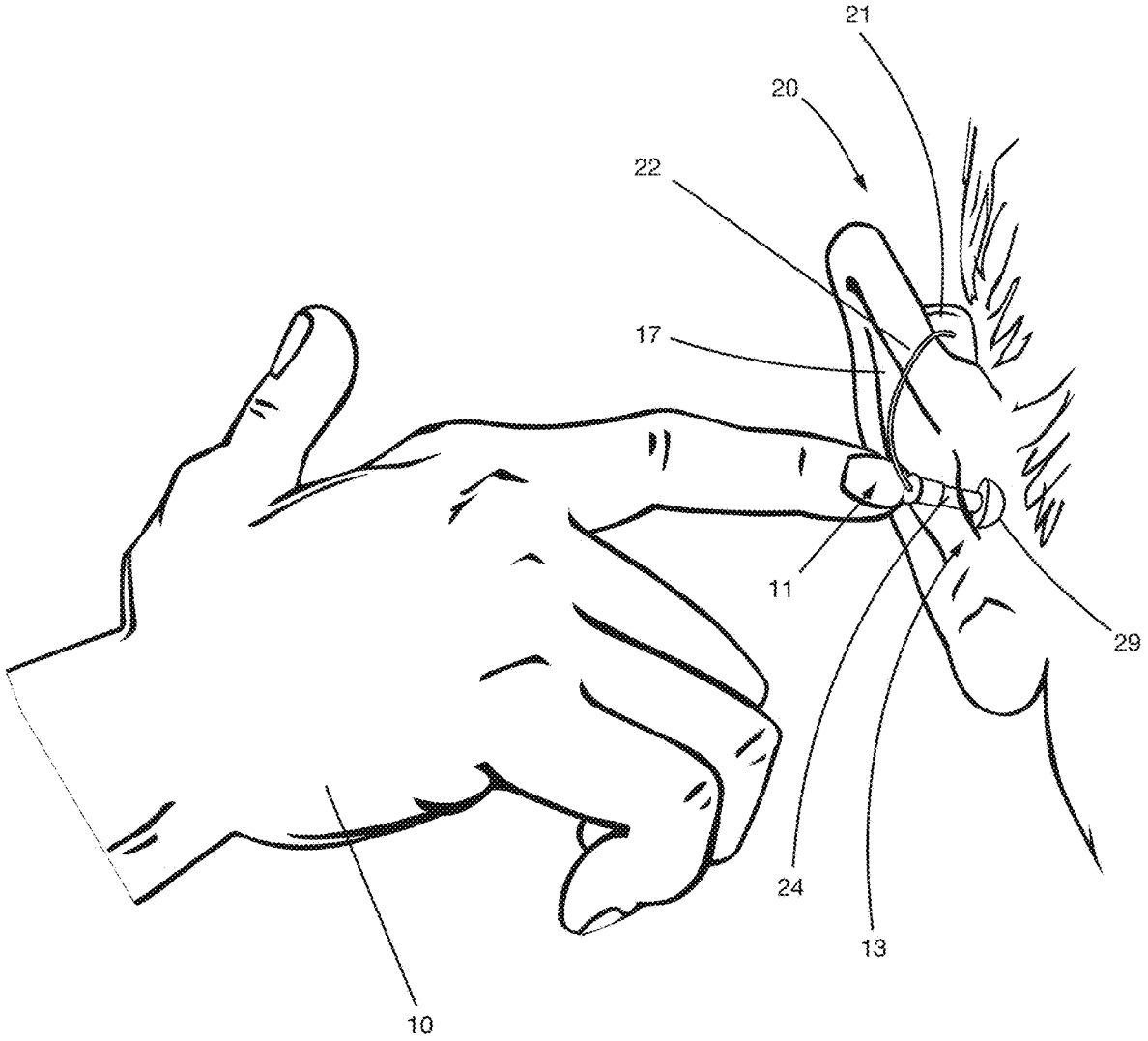
FIG. 1 is a perspective view of an ear and an example hearing aid.

FIG. 1 depicts an enlarged view of a user inserting an ear canal component 24 of a hearing aid 20 into the ear canal 13 with their hand 10. Specifically, the user uses their fingertip and/or fingernail 11 to guide, maneuver, and/or position the ear canal component 24 into the ear canal 13. The ear canal component 24 is connected to a main body 21 with a connector 22 (e.g., wire or acoustical mini sound tube). The main body 21 houses internal components of the hearing aid 20 such as a power source, electronic processing equipment, and/or the like.

Figure 2:
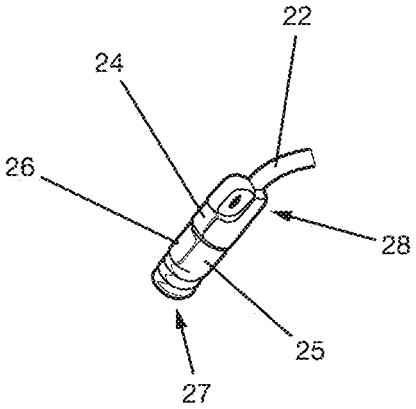
FIG. 2 is a perspective view of an example ear canal component of a hearing aid.

FIG. 2. depicts an example ear canal component 24 is greater detail. The ear canal component 24 has a housing 25 with an exterior surface 26, a first end 27, and an opposite second end 28. The first end 27 is the leading end of the ear canal component 24 as the ear canal component 24 is inserted into the ear canal 13 (FIG. 1). The second end 28 is connected to the connector 22. The size and/or shape of the housing 25 and/or exterior surface 26 can vary (e.g., cylindrical, rectangular), and the housing 25 can be made of any suitable material such as plastic or metal. A flexible dome 29 (FIG. 1) can be removably connected to the first end 27, and the dome 29 contacts and flexes when in the ear canal 13 (FIG. 1).

Figure 3:
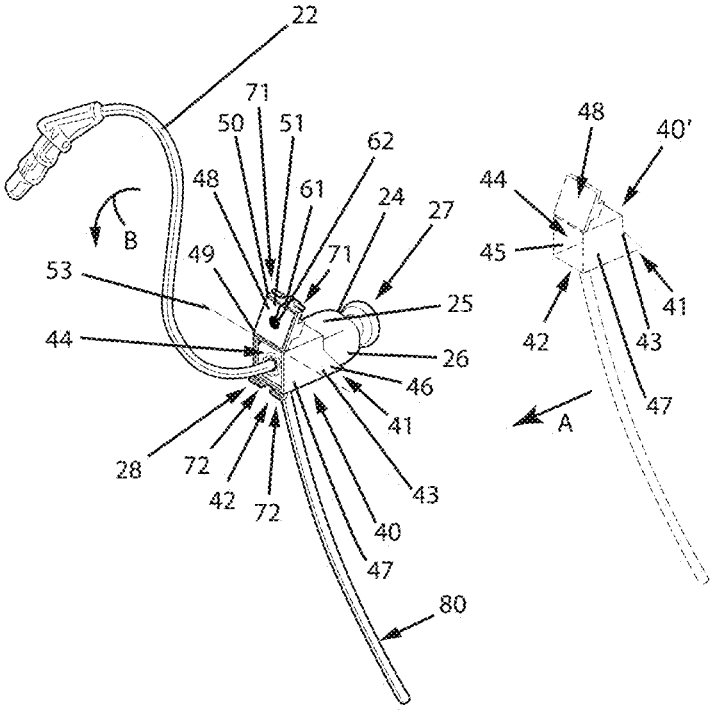
FIG. 3 is a perspective view of an example apparatus of the present disclosure on an example ear canal component of a hearing aid. A flap of the apparatus is in an open position. Note that the apparatus depicted in dashed lines illustrates the apparatus in a staging position in which the apparatus is separated from the ear canal component.
Figure 4:
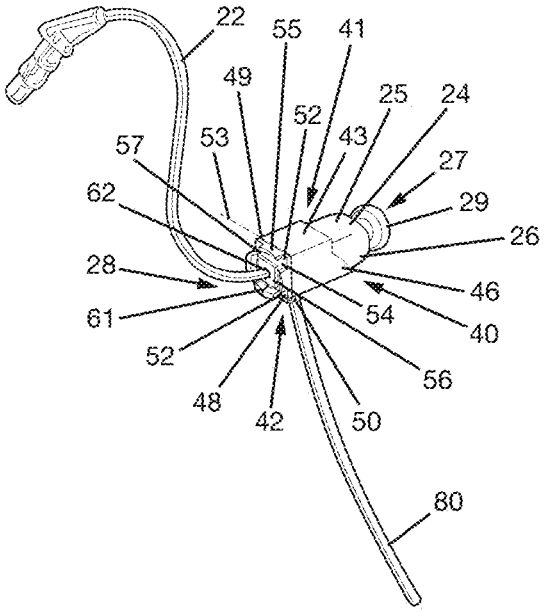
FIG. 4 is a perspective view of the apparatus of FIG. 3 with the flap in a closed position.
Figure 19:
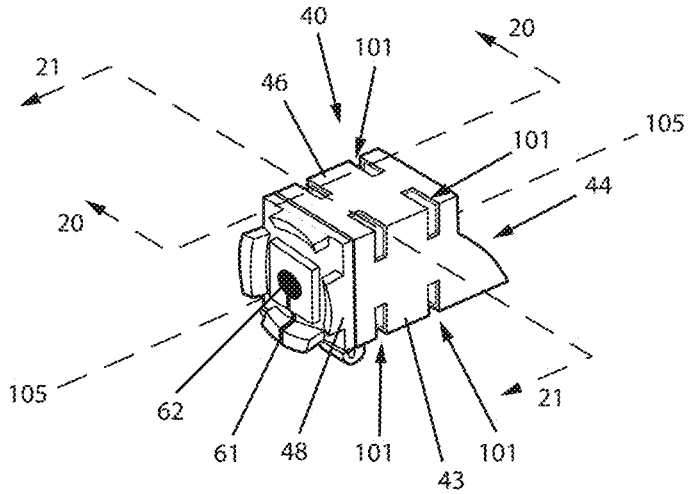
FIG. 19 is a perspective view of the apparatus of FIG. 18.
Figure 20:
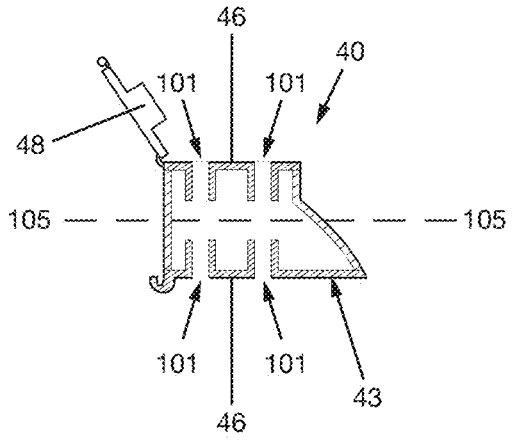
FIG. 20 is a cross-sectional view of the apparatus along line 20-20 on FIG. 19.

Referring now to FIGS. 3-4 an example apparatus 40 of the present disclosure is depicted coupled to an example ear canal component 24 of a hearing aid 20. The apparatus 40 is connected to the ear canal component 24 to help the user maneuver and/or properly position the ear canal component 24 into the ear canal 13. The apparatus 40 has a first end 41, an opposite second end 42, and a sleeve 43 that extends between the ends 41, 42. The sleeve 43 has a sidewall 47, a channel 44, and an interior surface 45 that defines the channel 44. The sleeve 43 and the channel 44 extend along a center axis 105 (see FIGS. 19-20). The sleeve 43 also has an exterior surface 46 that is opposite the interior surface 45. In certain examples, the size and shape of the sleeve 43 corresponds to the size and shape of the housing 25 of the ear canal component 24 (described further hereinbelow). Each end 41, 42 is open and has a hole through which the ear canal component 24 slides or passes into the channel 44.

A movable cap or flap 48 is connected to the second end 42 of the sleeve 43, and the flap 48 is movable into and between an open position (FIG. 3) and a closed position (FIG. 4). The flap 48 has a first edge 49 that is pivotably connected to the sleeve 43 and a second edge 50 that removably connects to the sleeve 43. The flap 48 pivots about a pivot axis 53 into and between the open position (FIG. 3) and the closed position (FIG. 4). The pivot axis 53 extends along an edge of the sleeve 43, and the pivot axis 53 extends transverse to the center axis 105 (see FIGS. 19-20). The flap 48 has a first surface 51 that closes the channel 44 when the flap 48 is in the closed position (FIG. 4) and an opposite second surface 52 that is exposed to the user when the flap 48 is in the closed position (FIG. 4). The second surface 52 may include one or more contact surfaces 54, gripping structures 55, projections 56, and/or the like that extend away from the second surface 52. Furthermore, grooves 57 may be defined between the components that extend away from the second surface 52. The components extending from the second surface 52, such as the gripping structures 55 and the projections 56, and/or the grooves 57 may support the user's fingertip 11 and increase maneuverability of the ear canal component 24 in order to achieve sufficiently deep insertion into the ear canal 13. Further details of other contact surfaces, gripping structures, projections, and grooves are described in U.S. Pat. No. 10,075,792, which is incorporated by reference above. When the flap 48 is in the open position (FIG. 3), the components extending from the second surface 52 and/or the grooves 57 are not in a position that helps the user maneuver the ear canal component 24. However, when the flap 48 is in the open position (FIG. 3), the user can easily couple the apparatus 40 to the ear canal component 24. When the flap 48 is in the closed position (FIG. 4), the components extending from the second surface 52 and/or the grooves 57 are in a useful position and the user can engage and/or contact the components extending from the second surface 52 and/or the grooves 57 to thereby maneuver the ear canal component 24 in the ear canal 13 (FIG. 1).

An example method for connecting the apparatus 40 to the ear canal component 24 is described hereinbelow. Referring specifically to FIG. 3, the apparatus 40' shown in dashed lines depicts the apparatus 40' in a staging position just before connecting the apparatus 40 (shown in solid lines) to the ear canal component 24. In this staging position, the second end 42 of the sleeve 43 is adjacent to the first end 27 of the ear canal component 24 and the channel 44 is aligned with the housing 25 of the ear canal component 24. The flap 48 is also in an open position such that the channel 44 is exposed from the second end 42 of the sleeve 43.

The apparatus 40 is connected to the ear canal component 24 by moving the apparatus 40 toward the ear canal component 24 (see arrow A) such that the sleeve 43 is pulled over and onto the housing 25 (see the apparatus 40 depicted in solid line). As such, the interior surface 45 of the sleeve 43 contacts the exterior surface 26 of the housing 25 and encircles or encloses the ear canal component 24. Further, the sleeve 43 at least partially encases the ear canal component 24. The sleeve 43 can be made of elastic material such that the sleeve elastically stretches over the housing 25. Engagement and/or contact between the interior surface 45 of the sleeve 43 and the exterior surface 26 of the housing 25 prevents the apparatus 40 from inadvertently sliding off the housing 25 (e.g., friction forces between the interior surface 45 of the sleeve 43 and the exterior surface 26 of the housing 25 prevent the apparatus 40 from inadvertently disconnecting from the housing 25). In certain examples, the sleeve 43 applies compressive forces to the housing 25 thereby decreasing the likelihood of the sleeve will slide off the housing 25.

As depicted in FIG. 3, the sleeve 43 is pulled onto the housing 25 (see arrow A) such that the second end 42 of the sleeve 43 is adjacent to the second end 28 of the ear canal component 24. To close the sleeve 43 onto the housing 25, the flap 48 is pivoted by the user (see arrow B) into the closed position as depicted in FIG. 4. The flap 48 is pivoted into the closed position (FIG. 4), and the connector 22 of the hearing aid 20 is passed through a slit 61 that extends from the second edge 50 to a center opening 62 of the flap 48. Accordingly, the flap 48 is in the closed position (FIG. 4), the connector 22 extends through the center opening 62 (see FIG. 4), and the contact surfaces 54, gripping structures 55, and/or the projections 56 extend away from the ear canal component 24. When the flap 48 is in the closed position (FIG. 4), the center opening 62 is centered on the center axis 105 (see FIG. 19).

When the flap 48 is in the closed position (FIG. 4), the second edge 50 of the flap 48 is adjacent to the sleeve 43 and coupled to the sleeve 43 such that the flap 48 does not inadvertently move toward the open position (FIG. 3). The connection between the second edge 50 of the flap 48 and the sleeve 43 can vary. For example, the flap 48 may be slightly pressed into the channel 44 such that the friction forces between the flap 48 and the sleeve 43 prevent the flap 48 from moving toward the open position. In another example, the second edge 50 may be received and held by friction or compression forces in a perimeter groove (not shown) in the sleeve 43.

In other examples, the apparatus 40 has a locking assembly 70 for locking the second edge 50 to the sleeve 43. Referring to FIG. 3, the locking assembly 70 has a first member 71 on the second edge 50 of the flap 48 and a mating, second member 72 on the sleeve 43. To lock the second edge 50 to the sleeve 43 and the flap 48 in the closed position (FIG. 4), the first member 71 engages or mates the second member 72. The size and/or shape of the first and second members 71, 72 can vary. For example, the first member 71 depicted in FIG. 3 is a cylindrical male shaped member and the second member 72 is a member that extends away from the sleeve 43 and defines a female groove that corresponds to the size and/or shape of the first member 71. The first member 71 is received (e.g., snapped) in the groove defined in the second member 72. Note that FIG. 3 depicts the locking assembly 70 with multiple first members 71 and second members 72. The members 71, 72 can be made from any suitable materials such as plastic and metal, and the members 71, 72 may elastically deform as the members 71, 72 are joined together.

Figure 5:
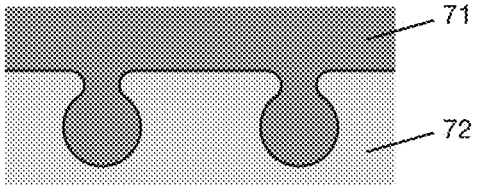
FIGS. 5-17 depict example members of a locking assembly which holds the flap in the closed position.
Figure 6:
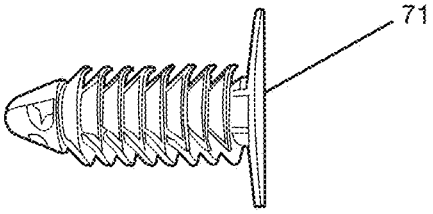
Figure 7:
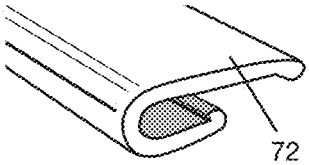
Figure 8:
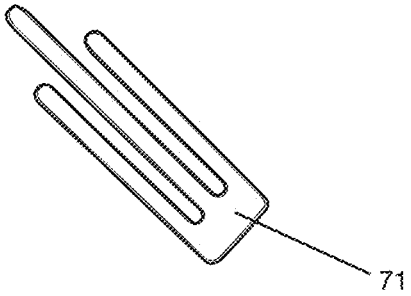
Figure 9:
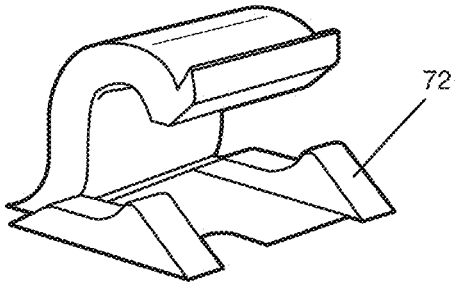
Figure 10:
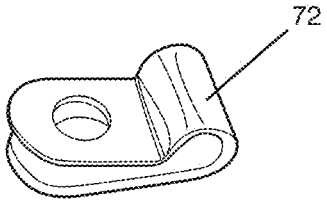
Figure 11:
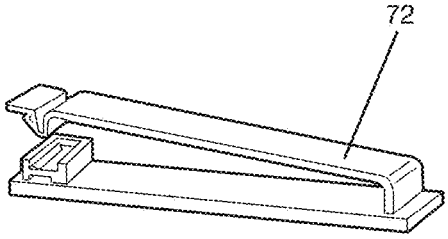
Figure 12:
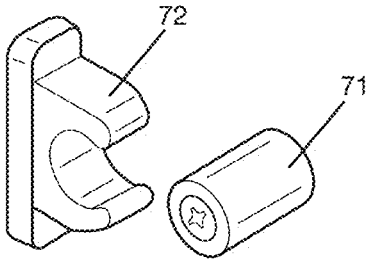
Figure 13:
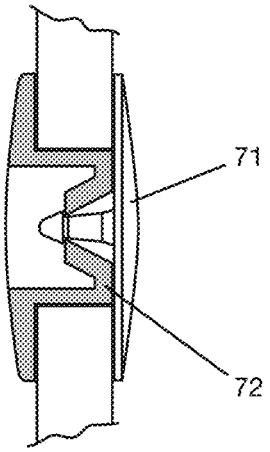
Figure 14:
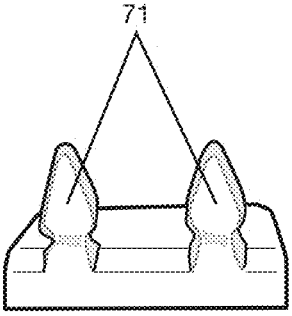
Figure 15:
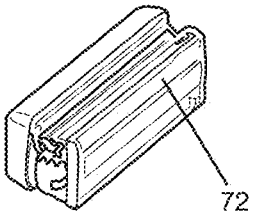
Figure 16:
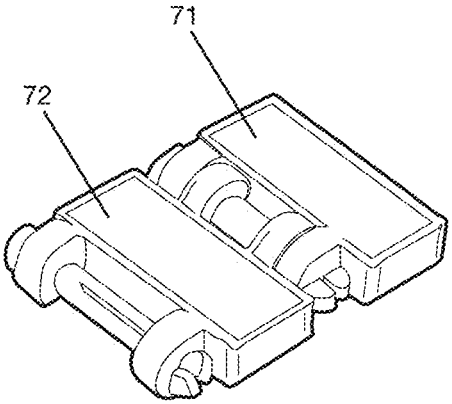
Figure 17:
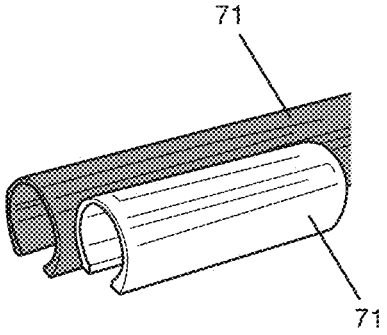
Figure 18:
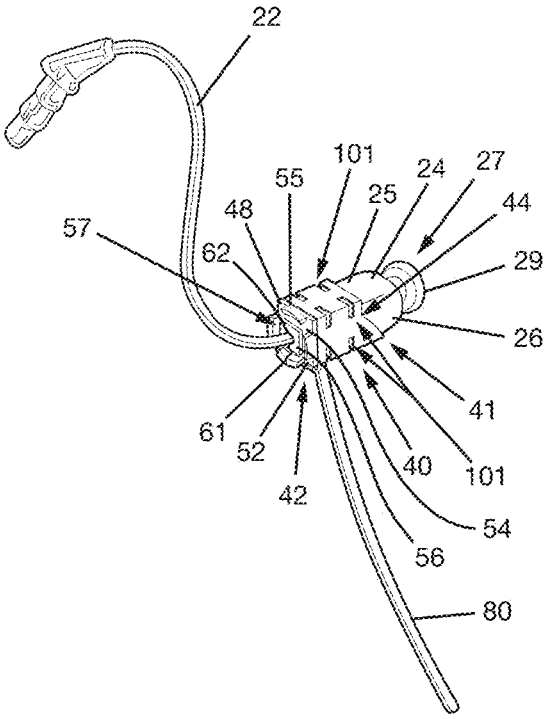
FIG. 18 is a perspective view of another example apparatus of the present disclosure on an example ear canal component of a hearing aid. A flap is in the closed position.

As noted above, the size and/shape of the members 71, 72 can vary, and FIGS. 5-17 depict examples of the members 71, 72. FIG. 5 depicts example circular first members 71 received in circular grooves of a second member 72. FIG. 6 depicts an example first member 71 as a barbed pin. FIG. 7 depicts an example second member 72 that is a "J"-shaped member. FIG. 8 depicts several example first members 71 that are forked-shaped. FIG. 9 depicts an example second member 72 with a "C"-shaped member that defines a groove. FIG. 10 depicts an example second member 72 that has opposing clamp members and a center channel. FIG. 11 depicts an example second member 72 that is a clip. FIG. 12 depicts an example second member 72 that has a "C"-shaped member and an example first member 71 that is a cylinder. FIG. 13 depicts an example first member 71 with a pin and an example second member 72 with a bore that receives the pin. FIG. 14 depicts an example first members 71 that are spade-shaped. FIG. 15 depicts an example second member 72 that defines a groove. FIG. 16 depicts pin-locks that include an example first member 71 and an example second member 72. FIG. 17 depicts an example first members 71 that are circular.

Optionally, the apparatus 40 has a retention tail 80 extending therefrom. The retention tail 80 is configured to retain the ear canal component 24 in the ear canal 13, and the retention tail 80 lies in the concha bowl 17 (FIG. 1) of the user.

Referring now to FIGS. 18-23, another example of the apparatus 40 with the flap 48 in a closed position is depicted coupled to the ear canal component 24. The sleeve 43 includes plurality of openings 101 that extend through the sleeve 43. Resilient members 102, such as O-rings (see FIGS. 21-23), are positioned around the sleeve 43 and aligned with a set of aligned opening 101 that encircle the channel 44 (see FIGS. 21-23). As such, the resilient members 102 engages and/or contacts the exterior surface 46 of the sleeve 43 and partially extends into the channel 44 to thereby engage the ear canal component 24 and hold the ear canal component 24 in the sleeve 43. In one example, the resilient member 102 is stretched around the sleeve 43 and the portions of the resilient member 102 elastically flex into and/or through the openings 101 to thereby engage the ear canal component 24. The resilient member 102 holds the ear canal component 24 in the channel 44, and the resilient member 102 may apply forces (e.g., compressive forces) to the ear canal component 24 and/or the sleeve 43 to thereby prevent the ear canal component 24 from inadvertently sliding out of the channel 44. Note that friction forces between the resilient member 102 and the ear canal component 24 may also prevent the ear canal component 24 from inadvertently sliding out of the channel 44. Note that the resilient member 102 engages or contacts the ear canal component 24 at one or more points. These features (and other related features) of the apparatus 40 are further described herein below. The present inventor has recognized that the features of the apparatus 40 described hereinbelow with respect to FIGS. 18-23 advantageously permits the apparatus 40 to be used with a wide variety of ear canal components 24 (e.g., the apparatus 40 can be coupled to many different ear canal components 24 produced by different manufacturers). The resilient member 102 can is made from any suitable material such as rubber and plastic.

Figure 21:
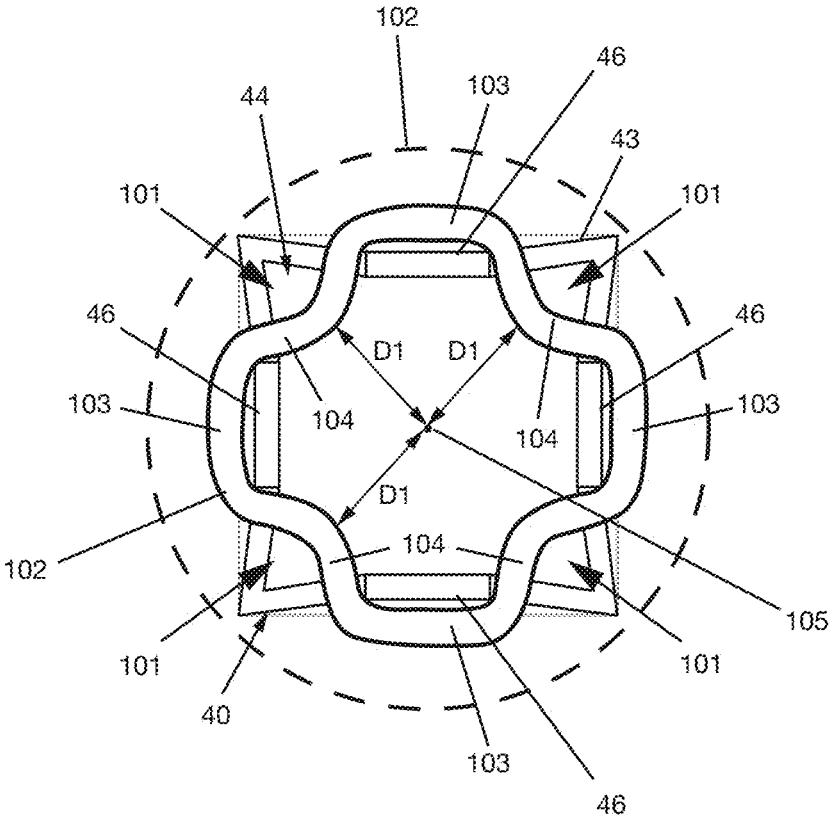
FIGS. 21-23 are other cross-sectional views of the apparatus along line 21-21 on FIG. 19.
Figure 22:
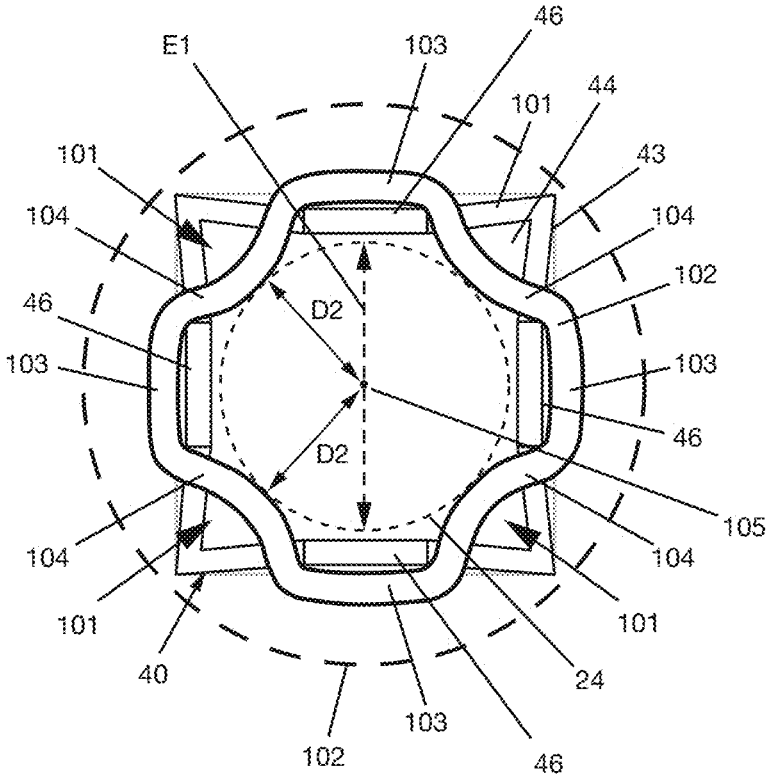
Figure 23:
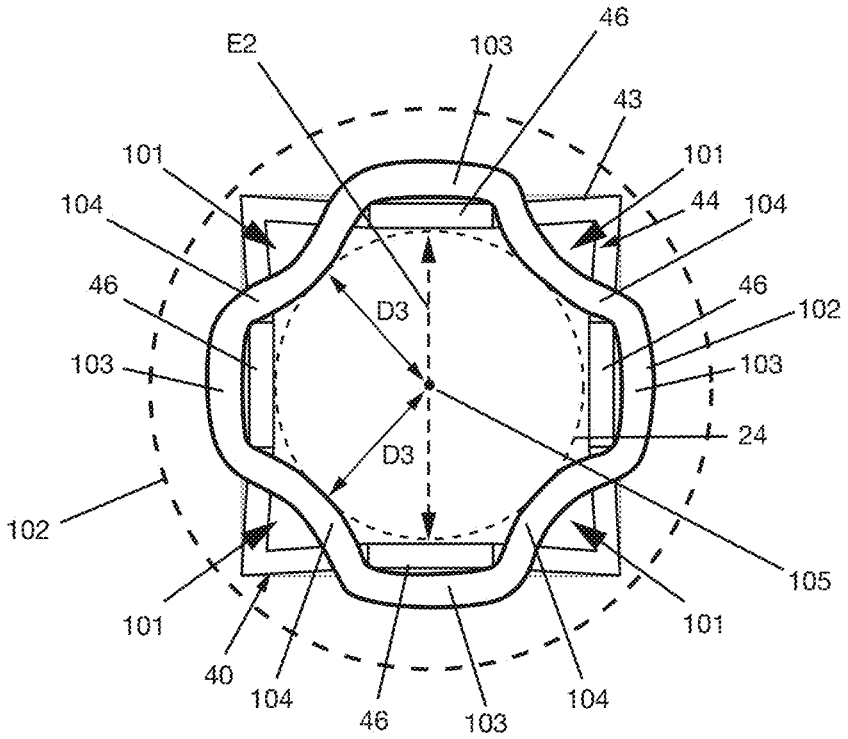

The user installs or couples the apparatus 40 to the ear canal component 24 by sliding the sleeve 43 over the ear canal component 24 while the flap 48 is in the open position (FIG. 3). The user then stretches one or more resilient members 102 (see dashed line on FIGS. 21-23 that represent the resilient member 102 stretched around the sleeve 43 such that the resilient member 102 can be moved into its proper position around the sleeve 43 and the ear canal component 24) around the exterior surface 46 of the sleeve 43 such that each resilient member 102 aligns with one or more openings 101. Upon releasing the resilient member 102, the resilient member 102 elastically flexes and deforms toward its original shape (not shown) and the resilient member 102 engages the exterior surface 46 of the sleeve 43. Accordingly, first portions 103 of the resilient member 102 are retained on the exterior surface 46 of the sleeve 43 and the remaining second portions 104 of the resilient member 102 pass through the openings 101 to engage and/or contact the ear canal component 24. The second portions 104 can apply compression forces to the ear canal component 24 thereby holding the ear canal component 24 in the sleeve 43. In some examples, engagement of the second portions 104 with the ear canal component 24 generates friction forces there between that prevent the ear canal component 24 from sliding out of the sleeve 43. Note that alternatively the resilient member 102 can be coupled to the sleeve 43 before the ear canal component 24 is inserted into the channel 44. In this example, as the user inserts the ear canal component 24 into the channel 44, the ear canal component 24 radially outwardly pushes (relative to a center axis 105 of the channel 44 that extends along the length of the sleeve 43 between the ends 41, 42) the second portions 104 of the resilient member 102. Thus, the resilient member 102 holds the ear canal component 24 in the sleeve 43. Note FIGS. 21-23 depict the sleeves 43 that deform radially inwardly due to the resilient members 102 applying radially inwardly directed forces on the sleeve 43. The cross-sectional shape of the sleeve 43 can vary, and in one example, the cross-sectional shape of the sleeve 43 without the resilient member 102 thereon is rectangular. However, when the resilient member 102 is placed onto the sleeve 43, the cross-sectional shape of the sleeve 43 is not rectangular (e.g., the middle portions of each sidewall of the sleeve 43 are pushed radially inwardly by the resilient member 102). In other examples, the sleeve 43 is made of a ridge material such that the sleeve 43 does not deform when the resilient member 102 is placed on the sleeve 43.

The inventor has recognized that the apparatus 40 depicted in FIGS. 18-23 may be advantageously used with different types, shapes, and/or diameter-sizes of ear canal components 24. For example, the channel 44 is sized to receive different types and sizes of the ear canal component 24 and the resilient members 102 elastically deform to engage with the ear canal component 24 regardless of the type, shape, and/or diameter-size of the ear canal component 24. Referring to FIG. 21, the resilient member 102 is depicted on the sleeve 43 and an ear canal component 24 is not in the channel 44. As such, the second portions 104 of the resilient member 102 radially inwardly extend into the channel 44. The inner surfaces of the second portions 104 are spaced apart from the axis 105 by a first distance D1. FIG. 22 depicts an ear canal component 24 (in dashed lines) with a first diameter E1 in the channel 44. Thus, the inner surfaces of the second portions 104 are spaced apart from the axis 105 by a second distance D2 that is greater than the first distance D1 (see FIG. 21). FIG. 23 depicts an ear canal component 24 (in dashed lines) with a second diameter E2 in the channel 44. Thus, the inner surfaces of the second portions 104 are spaced apart from the axis 105 by a third distance D3 that is greater than the second distance D2 (see FIG. 23). Note that while FIG. 23 depicts the ear canal component 24 contacting the interior surface of the sleeve 43, in other examples, the resilient member 102 may hold the ear canal component 24 in such a way that the ear canal component 24 is spaced apart from the interior surface of the sleeve 43.

Figure 24:
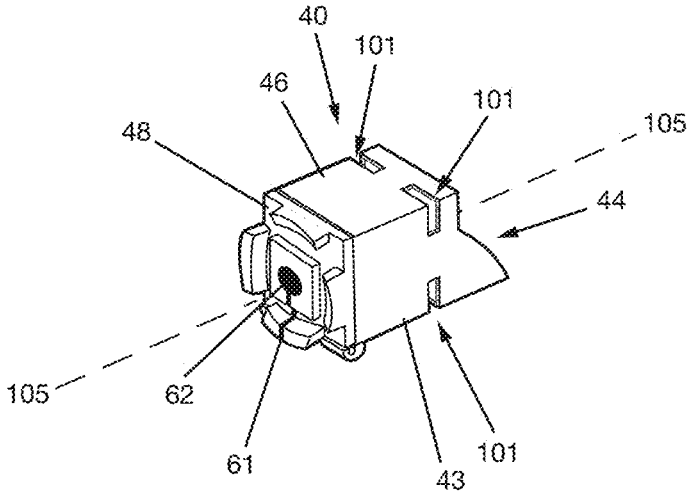
FIG. 24 is a perspective view of another example apparatus of the present disclosure.

Referring now to FIG. 24, the number of openings 101 can vary and the example apparatus 40 depicted in FIG. 24 has one plurality or set of four opening 101 (note that one of the openings 101 is not depicted in FIG. 24). The openings 101 in one set of openings are aligned with each other around the sleeve 43 and thereby encircle the channel 44. In one example, the openings 101 of the set of openings lie in a common plane (e.g., the openings 101 align with each other in the same plane) that extends through the sleeve 43 and the channel 44. In one example, the plane extends perpendicular to the center axis 105. The number of sets of openings 101 will correspond to the number of resilient members 102 that can be coupled to the sleeve 43. The number of openings 101 in each set of openings can vary (e.g., one, two, three, six). The number of openings 101 also corresponds to the number of second portions 104 of the resilient member 102 and the number of contact points between the resilient member 102 and the ear canal component 24. For example, three openings 101 in a set of openings corresponds to three second portions 104 (FIG. 21) and three contact points. The shape of the sleeve 43 can vary (e.g., square, circular, triangular)

Note that the sleeve 43 can be made of any suitable material such as silicone, plastic, and/or rubber. In the examples depicted in FIGS. 21-23, the sleeve 43 is made of materials that prevent the resilient members 102 from deforming the shape of the sleeve 43. That is, the sleeve 43 is rigid enough to prevent the resilient members 102 from deforming the shape of the sleeve 43.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for connecting to an ear canal component of a hearing aid, the apparatus comprising:

a sleeve having a first end, an opposite second end, and a channel extending between the first end and the second end, wherein the sleeve is configured to engage the ear canal component such that the ear canal component is in the channel;

a flap coupled to the sleeve and pivotable into and between an open position in which the channel at the second end of the sleeve is open and a closed position in which the flap closes the channel at the second end of the sleeve, wherein when the flap is in the closed position, the flap prevents the ear canal component from passing out of the channel through the second end of the sleeve; and a locking assembly that locks the flap in the closed position;

wherein the locking assembly has a first member on the flap and a second member on the sleeve, and wherein when the flap is in the closed position, the second member engages the first member to thereby lock the flap in the closed position; and wherein the first member mates with the second member.

2. An apparatus for connecting to an ear canal component of a hearing aid, the apparatus comprising:

a sleeve having a first end, an opposite second end, and a channel extending between the first end and the second end, wherein the sleeve is configured to engage the ear canal component such that the ear canal component is in the channel; and a flap coupled to the sleeve and pivotable into and between an open position in which the channel at the second end of the sleeve is open and a closed position in which the flap closes the channel at the second end of the sleeve, wherein when the flap is in the closed position, the flap prevents the ear canal component from passing out of the channel through the second end of the sleeve;

wherein the flap has an edge and a slit extending from the edge to a center opening spaced apart from the edge, and wherein the slit is configured to permit a connector of the ear canal component to pass therethrough to the center opening as the flap is moved into the closed position.

3. The apparatus according to claim 2, wherein the channel extends along a center axis and the center opening is centered on the center axis.

4. An apparatus for connecting to an ear canal component of a hearing aid, the apparatus comprising:

a sleeve having a first end, an opposite second end, and a channel extending between the first end and the second end, wherein the sleeve is configured to engage the ear canal component such that the ear canal component is in the channel and wherein the sleeve has an opening;

a flap coupled to the sleeve and pivotable into and between an open position in which the channel at the second end of the sleeve is open and a closed position in which the flap closes the channel at the second end of the sleeve, wherein when the flap is in the closed position, the flap prevents the ear canal component from passing out of the channel through the second end of the sleeve; and a resilient member on the sleeve that is configured to extend through the opening and engage the ear canal component to thereby prevent the ear canal component from sliding out of the channel.

5. The apparatus according to claim 4, wherein the opening is one opening of a plurality of openings, wherein the openings encircle the channel, and wherein the resilient member is configured is extend through the openings and engage the ear canal component.

6. The apparatus according to claim 4, wherein the resilient member is an O-ring.

7. The apparatus according to claim 4, wherein the opening is one opening of a first plurality of openings, wherein the openings of the first plurality of openings encircle the channel, and wherein the resilient member is a first resilient member configured to extend through the first plurality of openings and engage the ear canal component; and further comprising:

a second plurality of openings in the sleeve, wherein the openings of the second plurality of openings encircle the channel, and wherein the second plurality of openings are spaced part from the first plurality of openings; and a second resilient member configured to extend through the second plurality of openings and engage the ear canal component.

8. The apparatus according to claim 4, wherein the channel extends along a center axis, and wherein the resilient member is configured to radially outwardly flex as the ear canal component slides into the channel.

9. An apparatus for connecting to an ear canal component of a hearing aid, the apparatus comprising:

a sleeve having a first end, an opposite second end, an opening spaced between the first end and the second end, and a channel extending between the first end and the second end, the sleeve is configured to engage the ear canal component such that the ear canal component is in the channel; and a resilient member on the sleeve that extends through the opening to engage the ear canal component and prevent the ear canal component from inadvertently sliding out of the channel;

wherein the opening is one opening of a first plurality of openings, wherein the openings of the first plurality of openings encircle the channel, and wherein the resilient member is a first resilient member configured to extend through the openings in the first plurality of openings and engage the ear canal component; and a second plurality of openings in the sleeve, the openings of the second plurality of openings encircle the channel, wherein the openings of the second plurality of openings are spaced part from the first plurality of openings; and a second resilient member configured to extend through the openings of the second plurality of openings and engage the ear canal component.

* * * * *